US005080340A

United States Patent [19]

Hacknauer et al.

[11] Patent Number: 5,080,340

[45] Date of Patent: Jan. 14, 1992

[54] MODULAR FINISHER FOR A REPRODUCTION APPARATUS

[75] Inventors: Frank Hacknauer, Honeoye Falls; Steven M. Russel, Pittsford; Robert H. Shea, Victor, all of N.Y.

[73] Assignee: Eastman Kodak Company, Rochester, N.Y.

[21] Appl. No.: 636,786

[22] Filed: Jan. 2, 1991

[51] Int. Cl.[5] ..... B41L 43/12

[52] U.S. Cl. ..... 270/37; 270/45; 270/47

[58] Field of Search ..... 270/32, 37, 45, 47, 270/52, 53, 55, 57, 58; 493/419–421, 442, 443, 454, 405

[56] References Cited

U.S. PATENT DOCUMENTS

| | | | |
|---|---|---|---|
| 4,134,672 | 1/1979 | Burlew et al. . | |
| 4,169,674 | 10/1979 | Russel . | |
| 4,313,670 | 2/1982 | Caldwell . | |
| 4,497,478 | 2/1985 | Reschenhofer et al. | 270/53 |
| 4,509,732 | 4/1985 | Kanno | 270/37 |
| 4,595,187 | 6/1986 | Bober | 270/37 |
| 4,603,971 | 8/1986 | Kukucka et al. | 355/133 |
| 4,717,134 | 1/1988 | Iida | 270/45 |
| 4,871,158 | 10/1989 | May et al. | 270/53 |
| 4,878,656 | 11/1989 | Honjo et al. | 270/53 |
| 4,917,366 | 4/1990 | Murakami et al. | 270/53 |
| 5,007,625 | 4/1991 | Kremers | 270/53 |

FOREIGN PATENT DOCUMENTS

| | | | |
|---|---|---|---|
| 346851 | 12/1989 | European Pat. Off. | 270/53 |
| 74874 | 4/1988 | Japan | 270/47 |
| 235260 | 9/1988 | Japan | 270/37 |

*Primary Examiner*—Edward K. Look
*Assistant Examiner*—Therese M. Newholm
*Attorney, Agent, or Firm*—Lawrence P. Kessler

[57] ABSTRACT

An improved modular finisher apparatus, for use with a reproduction apparatus producing reproduction sets, for forming completely finished reproduction sets. The improved finisher apparatus comprises a receiver for receiving sheets of reproduction sets from the reproduction apparatus. A first feed path extends from the receiver to a sheet collector where received sheets are directed. Collected sheets are stapled into finished reproduction sets. A second feed path extends from the sheet collector to a set collector where finished reproduction sets are collected. The finisher also includes at least one of the following devices: a Z-folder, a saddle stitcher, and an insert tray. Sheet transport paths are provided to any of the included devices.

11 Claims, 6 Drawing Sheets

MODULAR FINISHER FOR A REPRODUCTION APPARATUS

CROSS-REFERENCE TO RELATED APPLICATIONS

This application is related to U.S. patent applications Ser. No. 07/636,792, entitled Saddle Stitcher for a Reproduction Apparatus Finisher, filed in the name of Russel et al; and Ser. No. 07/636,785, Z-folder for a Reproduction Apparatus Finisher, filed in the name of Shea et al, on even date herein.

BACKGROUND OF THE INVENTION

This invention relates in general to finishers for use with reproduction apparatus, and more particularly to a modular finisher which includes a stapling device and may optionally include any combination of auxiliary devices including a supplemental sheet insert tray, a Z-folding device, or a saddle stitcher.

Today's ever increasing document information flow, in the form of paper documents, necessitates the ability to reproduce multi-page documents in a timely and efficient manner. As a result, reproduction apparatus, such as electrostatographic copier/duplicators, electronic printers, or the like, have been significantly improved as to their sophistication of operation, ease of use, and speed. In order to take full advantage of high speed reproduction apparatus, handling of the original information to be reproduced and of the completed reproductions into completely finished sets so as to match overall reproduction output productivity with reproduction apparatus speed has assumed increased importance.

Recent significant advances in the state of the art of reproduction apparatus deal with the handling of original information for information input to such apparatus. One such novel original information handling device, referred to as a recirculating document feeder, is shown for example in U.S. Pat. No. 4,169,674, issued Oct. 2, 1979, in the name of Russel. With the recirculating document feeder of the shown type, document sheets from a collated document sheet stack are circulated seriatim from the stack of document sheets to an exposure station of a reproduction apparatus for copying and then returned to such stack, in order, a number of times equal to the desired number of reproductions to be made of such stack. As a result, the collected reproductions are in precollated sets which eliminates the need for further complex and expensive collation equipment. Of course, reproduction apparatus which handle original information electronically may also produce the desirable precollated reproduction sets.

The production of precollated reproduction sets has an additional advantage in that the sets are immediately available for further handling to provide desired completely finished reproduction sheet sets. This of course improves the overall productivity of the reproduction system. A typical example of such further reproduction sheet set handling is stapling of the sheets in a set together to form the completely finished reproduction set. Finisher apparatus to carry out reproduction set stapling is shown in U.S. Pat. No. 4,134,672, issued Jan. 16, 1979, in the name of Burlew et al.

Although finishers of the above type have been very successful, they are limited in that they typically can effect only one type of finishing. Completed reproduction sets may require additional or other finishing operations, such as for example folding oversized sheets, saddle sitching the reproduction set to form a booklet, or insertion of supplemental sheets (e.g., covers). Separate auxiliary devices to accomplished these various ends are available in the industry today, although for the most part these devices are of the off-line type. That is to say, such auxiliary devices are not integrally associated with the reproduction apparatus (and basic finisher apparatus) and require either manual or mechanical intervention to bring reproduction sets to such devices in a form in which such auxiliary devices can perform the desired operation thereon. This adds expense to the overall reproduction process, and complexity to the total reproduction apparatus system, without adding to the efficiency or increasing the productivity of operation thereof.

SUMMARY OF THE INVENTION

This invention is directed to an improved modular finisher apparatus, for use with a reproduction apparatus, for forming completely finished reproduction sets. The improved finisher apparatus comprises a receiver for receiving sheets of reproduction sets from the reproduction apparatus. A first feed path extends from the receiver to a sheet collector where received sheets are directed. Collected sheets are stapled into finished reproduction sets. A second feed path extends from the sheet collector to a set collector where finished reproduction sets are collected. The finisher also includes at least one of the following devices: a Z-folder, a saddle stitcher, and an insert tray. Sheet transport paths are provided to any of the included devices.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
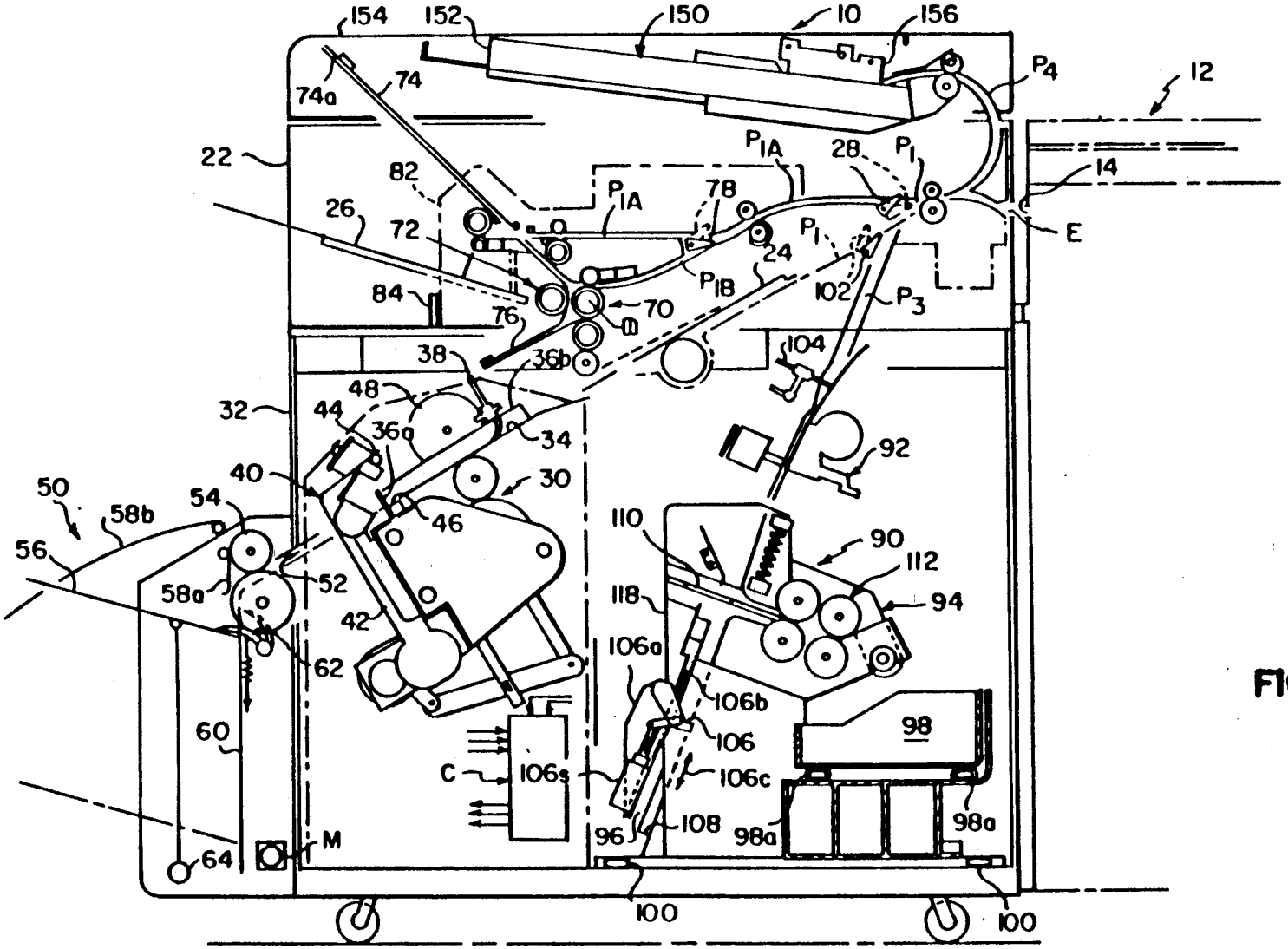
FIG. 1 is a front elevational view, in cross-section, of the modular finisher according to this invention, with portions shown schematically, removed, or broken away to facilitate viewing.

Referring now to the accompanying drawings, FIG. 1 shows the improved modular finisher apparatus according to this invention, designated generally by the numeral 10. The finisher apparatus 10 may be associated with an electrostatographic copier or copier/duplicator, a thermal or electronic printer, or a photographic printer, or any other like reproduction apparatus. The reproduction apparatus of the illustrated embodiment, shown only in part in FIG. 1, is designated generally by the numeral 12. The purpose of the modular finisher 10 is to efficiently finish reproduction sets from any conventional well known reproduction apparatus to form completely finished reproduction sets of a desired configuration at a speed which makes maximum use of the speed of the reproduction apparatus. As used herein, the term "reproduction sheets" refers to sheets bearing information reproduced in any well known manner by the reproduction apparatus or other sheets inserted into a reproduction set, such as for example blank sheets, cover sheets or tab stock; and the term "reproduction sets" refers to a plurality of reproduction sheets which when viewed together make up a copy corresponding to a multi-page original information bearing document.

The timing and control of the various operative components of the modular finisher apparatus 10 with respect to each other and to the reproduction apparatus are controlled by a logic and control unit C including a microprocessor for example. The microprocessor receives input and timing signals from sensors (not shown) located at points in the paths of sheets through the finisher and associated with the components of the finisher. Based on such signals and a program for the microprocessor, the unit C produces signals to control the operation of the various components of the finisher. The production of a program for commercially available microprocessors suitable for use with this invention is a conventional skill well understood in the art. The particular details of any such program would, of course, depend on the architecture of the selected microprocessor.

Typical high productivity reproduction apparatus reproduce information on individual sheets in a precollated manner so that the sheets upon exiting the apparatus (at chute 14 in the illustrated embodiment) may be readily grouped into reproduction sets. To provide precollated reproduction sets of information contained in a document sheet stack, the reproduction apparatus may include a recirculating document feeder of the type described in the aforementioned U.S. Pat. No. 4,169,674, operating to recirculate document sheets from a document sheet stack seriatim from the stack of document sheets to an exposure station of a reproduction apparatus for copying and then returned to such stack, in order, a number of times equal to the desired number of reproductions to be made of such stack. Alternatively, such as with reproduction apparatus including a mechanism for capturing or creating information electronically, information can be electronically acquired and saved in a memory storage device to thereafter be recalled at a desired time to form the desired number of multiple precollated reproductions sets.

As noted above, the production of precollated reproduction sets enables the ready production of completely finished reproduction sets to markedly improve the overall productivity of the reproduction system. The finisher 10 according to this invention, constructed to provide a device in modular form which can accomplish the production of completely finished reproduction sets in a selectable variety of forms, includes an upper transport module 20, a stapling module 30, and an output hopper 50. Additionally, the finisher has provisions for optional auxiliary devices selected from the group including a Z-folder 70, a saddle stitcher 90, and an insert tray 150. By its unique construction, the modular finisher 10 according to this invention can readily accommodate any combination of the optional auxiliary devices.

The upper transport module 20 of the finisher 10 is incorporated in a self-contained housing 22 having a first transport path $P_1$. The transport path $P_1$ is defined, for example, by wire-form or sheet metal guides and driven nip rollers located at appropriately spaced intervals with respect to the guides. The upper transport module 20 is positioned such that the entrance E to the path $P_1$ is adjacent to the chute 14 of the reproduction apparatus 12. In this manner, the information-bearing reproduction sheets of a reproduction set exiting the apparatus 12 are received seriatim in the path $P_1$ and directed under normal operating circumstances to a sheet delivery station 24.

The sheet delivery station 24 (which may be for example of the type shown and described in U.S. Pat. No. 4,930,765, issued June 5, 1990, in the name of Russel et al) directs the received sheets of a reproduction set to the stapling module 30. The station 24 includes a selectively adjustable ramp which elevates at selected intervals to guide delivered sheets in a manner that assures that subsequently delivered sheets are directed to the top of a stack of sheets as they are collected in the stapler module 30 described hereinbelow. It is readily apparent that without such elevation of the delivery station ramp, there may be a condition where such subsequently delivered sheets jam into the previously delivered sheets.

Under certain circumstances, it may be desired to review a full reproduction set prior to accomplishing finishing operations thereon. Accordingly, the upper transport module 20 also includes a bypass transport path $P_{1A}$ similarly defined by wire-form or sheet metal guides and spaced driven nip rollers. In path $P_{1A}$, sheets are directed to a proof set hopper 26 readily accessible to an operator for retrieval and review. A diverter 28 normally positioned (solid line position of FIG. 1) to maintain transport of sheets along the path $P_1$. However, when it is desired to review a reproduction set prior to finishing, the diverter 28 is selectively moved by a solenoid actuator, for example, to a position (broken line position of FIG. 1) to direct sheets into the Path $P_{1A}$. Typically under a circumstance when review of a reproduction set is desired prior to finishing, the reproduction apparatus may be programmed to produce an additional reproduction set to the desired number of reproduction sets. The sheets constituting the first reproduction set are directed to the hopper 26 to form, in effect, a proof set for the desired review. Production of the second set may then be delayed for a period of time sufficient to accomplish review of the proof set. If, after review, the proof set is found to be in the desired condition ready for finishing, the diverter 28 is returned to its normal position so that sheets constituting the second reproduction set (and all subsequently produced reproduction sets) are directed to the sheet delivery station 24 to begin the finishing process. Of course, if the reproduction set is not in the desired condition, the operation of the reproduction apparatus 12 can be cancelled and reset to correct the condition of the set before repeating the reproduction process.

Figure 2:
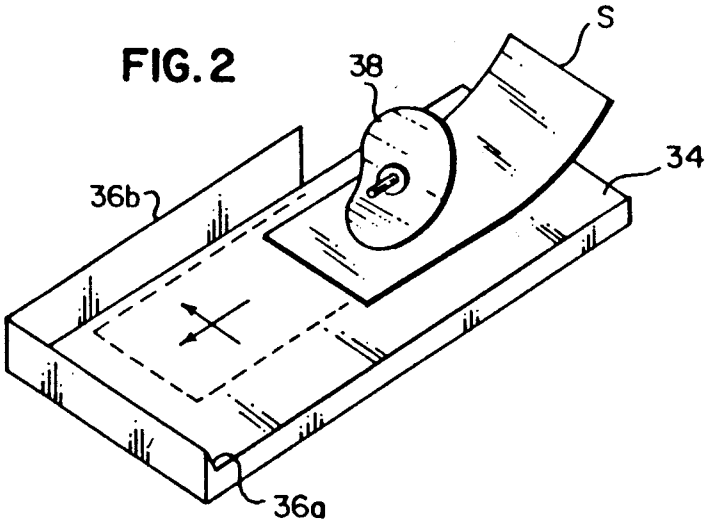
FIG. 2 is a view in perspective of the support tray of the stapling module of the modular finisher.

The stapling module 30 is incorporated in a self-contained housing 32. The housing 32 serves to support the housing 22 of the upper transport module 20 at a desired vertical location relative to the sheet exit chute 14 of the reproduction apparatus 12. The stapling module includes a tray 34 positioned to accept the sheets making up a full reproduction set from the sheet delivery station 24 of the upper transport module 20. The sheets of the reproduction set, delivered seriatim through the station 24, are respectively corner registered on the tray 34 against a registration gate 36*a* selectively located to intercept the reproduction set travel path and an edge guide 36*b* at right angles to the gate. Such corner registration may be effected for example by a rotating flexible disk jogger 38, or any other well known mechanism which can urge the individual sheets of the reproduction set in a direction perpendicular to sheet travel against the gate and edge guide. As illustrated in FIG. 2, a sheet S is moved in mutually perpendicular directions respectively by the jogger 38, rotating in the direction of its associated arrow, and under the influence of gravity, in the general direction of sheet travel. The sheet S thus moves from its solid line position through its broken line position into the corner formed by gate 36*a* and edge guide 36*b*.

Once all of the sheets making up the full reproduction set are properly corner registered, a stapling assembly 40 controlled by unit C is activated to place staples at a desired location (or plurality of locations) along the lead edge of the reproduction set registered against the gate 36*a*. An exemplary stapling assembly is shown and described in U.S. Pat. No. 4,903,952, issued Feb. 27, 1990, in the name of Russel et al. The stapling assembly 40, of the type disclosed in the Russel et al patent, is described herein only to the extent necessary for a complete understanding of the modular finisher 10 according to this invention. Such stapling assembly includes a single staple unit 42 movable along rails relative to the lead edge of the registered reproduction set, and has an off-set pivotable clincher 44 operating in timed conjunction with a staple head 46 to effect stapling of such registered set. Of course, the stapling assembly may be of any suitable construction, such as for example having a plurality of relatively fixed location staple heads, or having a pivotable staple head acting in conjunction with a relatively fixed location clincher. After the reproduction set has been stapled by the stapling assembly 40, the registration gate 36*a* is moved to a remote location (out of the travel path for the stapled reproduction set) and an ejector roller 48 urges the stapled set from the tray 34 toward the output hopper 50.

The output hopper 50 is attached to the housing 32 adjacent to an external wall thereof. An entrance slot 52 in the external housing wall provides for communication between the output hopper 50 and the stapling module 30. As such, stapled reproduction sets (or alternatively sets which pass directly through the stapling module without being stapled) are directed to the output hopper and stacked for ready operator retrieval. A pair of foam rollers 54 urge the reproduction sets toward a tray 56 angled from the horizontal in an "up hill" direction relative to the path of the incoming reproduction sets. The rollers 54 are of a relatively large diameter foam construction to enable the rollers to handle a wide variety of thickness of reproduction sets. A pair of dangler arms 58*a*, 58*b*, formed of relatively light weight flexible material intercept the travel path of the incoming reproduction sets to urge the sets onto the tray 56.

Due to the angle of the tray 56 with respect to the horizontal, the incoming reproduction sets are urged by gravitational forces to a location where their initial trailing longitudinal edge becomes the leading edge and engages a guide plate 60. In this manner the stack of reproduction sets on the tray 56 are relatively aligned against the guide plate. A plurality of fingers 62 (one shown in FIG. 1) are movable under the control of unit C to a remote position (broken line) relative to the incoming reproduction sets as a set is being registered against the guide plate 60, and to a position (solid line) overlying the set stack once a set has been registered. The fingers 62 are spring urged for example to apply a downward force on the stack of reproduction sets on the tray 56 to hold the set stack against the guide plate 60 thereby substantially preventing dishevelment of the stack.

The elevation of the tray 56 is controlled by an elevator mechanism 64 of any suitable type, such as for example a spring-urged support, a rotating screw thread, a chain drive or the like. The tray 56 is lowered by the elevator mechanism 64 as reproduction sets are delivered and stacked on the tray. Further, a motor M connected to the output hopper 50 selectively reciprocates the hopper in a direction cross-track relative to the path of incoming reproduction sets delivered to the tray 56. The timing of reciprocation of the output hopper is selected such that sequentially received reproduction sets are offset for ease of separation and removal from the tray by an operator.

Figure 3A:
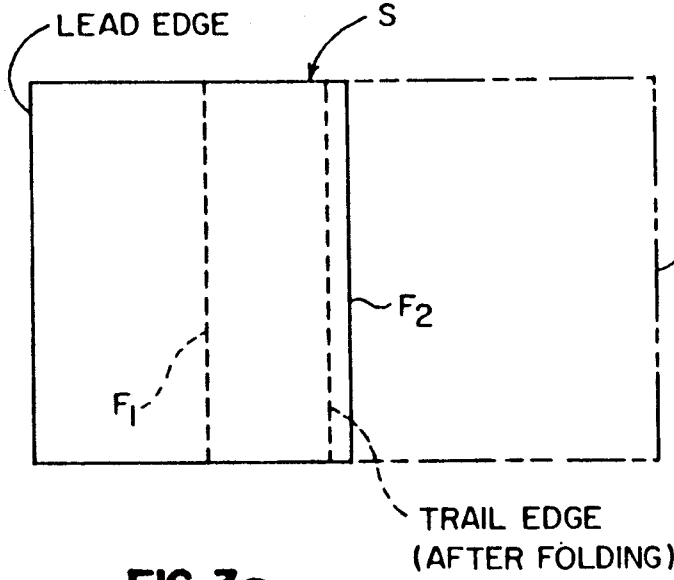
FIG. 3*a* and 3*b* are plan and front elevational views respectively of a sheet folded by the Z-folder of the modular finisher.
Figure 3B:
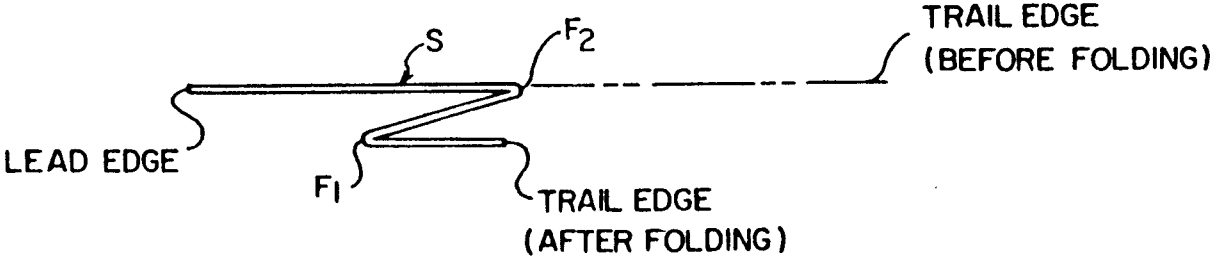

Turning now to the optional auxiliary devices, the module defining the Z-folder 70 will first be described. The Z-folder 70 is for the express purpose of folding large individual sheets into a reduced overall size where the folded sheets can be included for example in a booklet or stack with other smaller sized sheets. As an illustrative example, an 11"×17" sheet is folded so that its overall dimensions are 11"×8½" (see FIGS. 3*a*, 3*b*) for inclusion in a reproduction set with basic overall dimensions of 11"×8½". The Z-folder 70 includes a driven cluster of rotating rollers 72 and sheet guide chutes 74 and 76 which cooperatively act on a sheet to achieve the desired folded configuration for the sheet. The cluster of rollers 72 and guide chutes 74 and 76 are mounted on a frame 82 readily receivable in the housing 22 of the upper transport module 20 on cooperating slide guides 84 for example. In this manner, if it is desired to include a Z-folder in the finisher 10, a Z-folder module is merely slid into place in the finisher.

When it is desired to effect folding of a sheet, such sheet is transported along the path $P_{1A}$ and the directed by a diverter 78 into the path $P_{1B}$. The diverter 78 is controlled for example by a solenoid actuator for movement to a position (solid line position of FIG. 1) for directing sheets along the path $P_{1A}$ to the Z-folder 70 or to a position (broken line position of FIG. 1) for directing sheets to the proof set hopper 26.

Figure 4E:
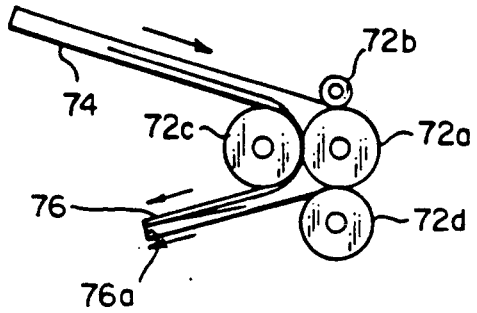
FIGS. 4*a*–4*h* are front elevational views showing, in sequence, the steps of operation for the Z-folder of the modular finisher.
Figure 4F:
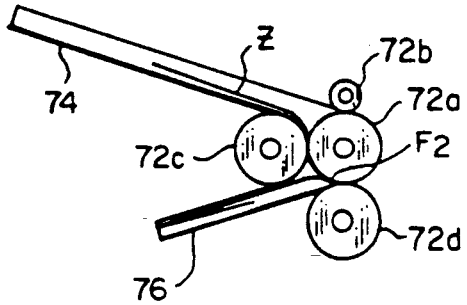
Figure 4G:
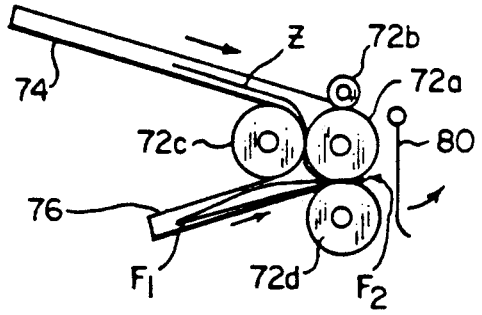
Figure 4H:
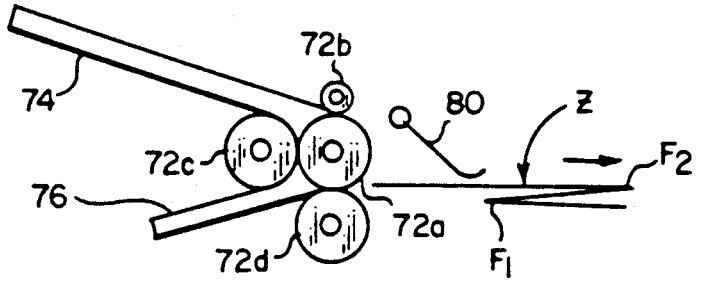
Figure 4A:
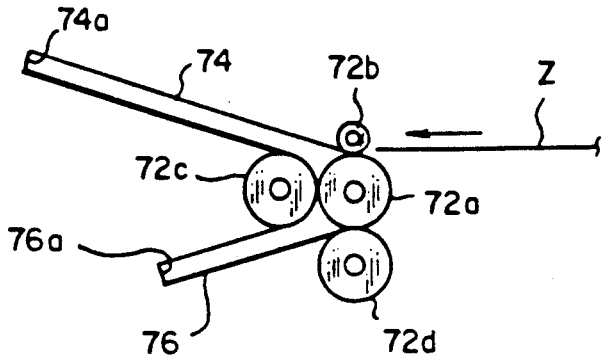

In the folding operation for the Z-folder 70, a sheet Z in the path $P_{1B}$ is urged into the nip between rotating roller 72*a*, driven by a motor to become a driving roller, and idler roller 72*b* of the roller cluster 72 (see FIG. 4*a*).

Figure 4B:
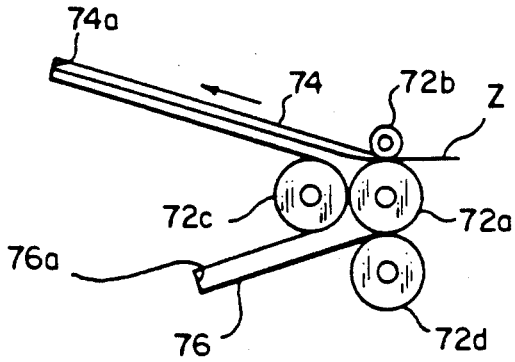
Figure 4C:
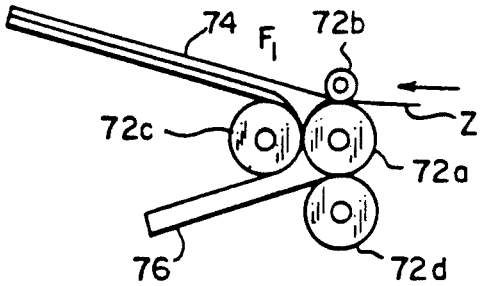
Figure 4D:
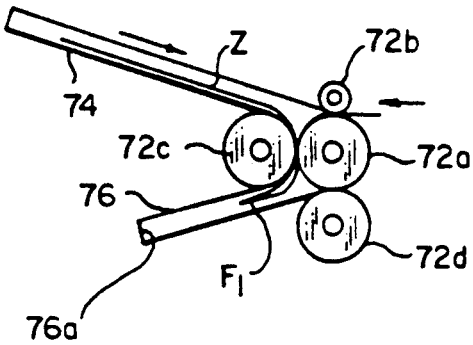
Figure 5:
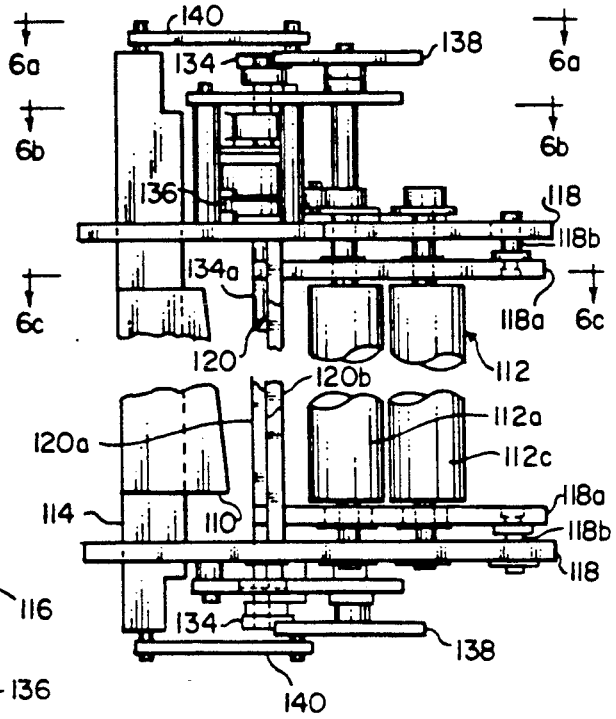
FIG. 5 is a top plan view of the folding mechanism of the saddle stitcher of the modular finisher according to this invention, with portions removed or broken away to facilitate viewing.

The roller pair 72a, 72b urge the sheet into the upper chute 74 until the lead edge of the sheet engages an adjustable stop 74a (see FIG. 4b). The adjustment of the stop 74a is selected such that the distance between the stop 74a and the first fold nip between the rollers 72a and 72c is substantially equal to the desired distance between the lead edge of the sheet and the first fold $F_1$ (see also sheet S in FIGS. 3a, 3b). Since the stop 74a prevents the sheet Z from moving further into the chute 74, the urging of the sheet by the rollers 72a and 72b causes the sheet to buckle and be fed into the first fold nip between the rollers 72a and 72c (see FIG. 4c). The first fold $F_1$ is then formed by the rollers 72a and 72c, and the folded sheet is urged by such rollers into the lower chute 76 (see FIG. 4d).

The sheet Z, with the first fold $F_1$ now being the leading edge, continues to be driven into the chute 76 until such new lead edge engages the stop 76a (see FIG. 4e). Similarly to the action described above relative to accomplishing the first fold $F_1$, the stop 76a prevents the sheet from moving further into the chute 76. The urging of the sheet Z by the rollers 72a and 72c thus causes the sheet to buckle and be fed into the second fold nip between the rollers 72a and 72d (see FIG. 4f). The second fold $F_2$ is then formed by the rollers 72a and 72d (see FIG. 4g), and the folded sheet is thereafter urged by such rollers in a direction out of the Z-folder opposite to its incoming direction (see FIG. 4h). The distance between the stop 76a and the second fold nip between the rollers 72a and 72d is designed to assure that the distance between the second fold $F_2$ and the initial lead edge of the sheet Z is substantially equal to the desired overall dimension of the sheet in the in track direction for the Z-folded sheet. The Z-folded sheet is then directed by the rollers 72a and 72d to an area where the sheet overlies the sheet delivery station 24. When the sheet clears the driven roller cluster 72 of the Z-folder, it is urged by a dangler member 80 onto the station 24, and then, under the influence of gravity, changes its direction of travel. The folded sheet can thus be delivered through the finisher 10 for any desired further operation thereon, just as any other delivered sheet.

A unique aspect of the Z-folder 70 is that it is constructed so as not to interfere with the bypass of sheets to the proof set hopper 26 even though it crosses the path $P_{1A}$ thereto. To accomplish this end, the upper chute 74 of the Z-folder has a slot 74b formed therein (see FIG. 1). The slot 74b is aligned with the path $P_{1A}$ so that a sheet traveling in such path can be directed without interference to the hopper 26. This arrangement serves to enable the finisher 10 according to this invention to have its desired multi-functionality in a distinctly compact configuration.

The module defining the optional saddle stitcher 90 of the modular finisher 10 according to this invention is for the purpose of providing the finisher with the capability of making center stapled and folded booklets. The saddle stitcher 90 has five major components: a transport path $P_3$, a stapling mechanism 92, a folding mechanism 94, an edge registration assembly 96, and a booklet-receiving output hopper 98. As with the optional Z-folder module 70, the major components of the saddle stitcher are readily receivable in the finisher 10. Particularly, the major components are, for example, slidably receivable on cooperating slide guides 100 in the housing 32. In this manner, if it is desired to include a saddle stitcher module 90 in the finisher 10, the components of the saddle stitcher module are merely received in place in the finisher.

The transport path $P_3$ for the saddle stitcher 90 is located such that it communicates with the path $P_1$ of the upper transport module 20 downstream, in the direction of sheet travel, from the diverter 28. A diverter 102, associated with the path $P_3$, is movable for example by a solenoid actuator to a position (solid line position of FIG. 1) remote from the path $P_1$, or to a position (broken line position of FIG. 1) intercepting the path $P_1$ to direct sheets into the path $P_3$. Sheets received seriatim in the path $P_3$ are aligned in the cross-track direction by a jogger mechanism 104 (similar for example to the jogger 38 associated with the stapling module 30).

The lead edges of the respective cross-track aligned sheets comprising a reproduction set are registered against a first gate 106 of the registration assembly 96 located to intercept the path $P_3$. In order to accommodate for formation of neat booklets from reproduction sets of various overall dimensions, the gate 106 must be adjustable along the path $P_3$ to properly locate the center staples for the booklets. Accordingly, the gate 106 is mounted on a support 106a adjustable along a slide bar 106b in the direction of sheet travel (i.e., the direction of arrow 106c in FIG. 1). Adjustment of the support 106a positions the first gate 106, when in its path intercepting position, to locate the lead edges of the delivered sheets at a preselected distance from the stapling line defined by the stapling mechanism 92. Such preselected distance is desirably substantially equal to one-half the dimension of the sheets in the sheet travel direction.

Once the requisite number of sheets for completing a full reproduction set have been delivered to the saddle stitcher module 90, the stapling mechanism 92 thereof is actuated by the control unit C to staple the reproduction set along the stapling line, substantially corresponding to the center line of the sheets in the sheet travel direction. After stapling has been accomplished, the gate 106 is pulled out of the path $P_3$ by a solenoid actuator 106s enabling the stapled reproduction set to continue its travel in the path $P_3$ under the influence of gravity for example. The stapled reproduction set continues its travel until the lead edge thereof is registered against a second gate 108 located to intercept the path $P_3$ downstream of the gate 106.

The gate 108 is adjustable in the direction of sheet travel to locate the lead edges of the delivered stapled reproduction set sheets at a preselected distance from the folding line defined by the folding mechanism 94. Such preselected distance is desirably substantially equal to one-half the dimension of the sheets in the sheet travel direction. Another way of looking at the adjustable placement of the gate 108 is that the gate 108 should be located a distance from the gate 106 substantially equal to the distance between the stapling line defined by the stapling mechanism 92 and the folding line defined by the folding mechanism 94. In this manner, when the stapled reproduction set is delivered to the gate 108, the established folding line will correspond to the stapling line such that folding accomplished by the mechanism 94 occurs on the center line of the sheets in the sheet travel direction resulting in formation of a neat booklet from the reproduction set.

As is apparent, the distance between the staple line as defined by the stapling mechanism 92 and the folding line as defined by the folding mechanism 94 is fixed. Accordingly, any adjustment of the first gate 106 necessitates a similar (substantially equal) adjustment of the second gate 108. Therefore, for the simplicity of construction and convenience of operation, the adjustability of the second gate 108 may be accomplished by connecting the second gate to the support 106*a* for the first gate for movement therewith to provide simultaneous corresponding adjustment of the gates.

The folding mechanism 94 includes a knife blade 110 selectively actuatable into cooperative relation with a double set of folding nip rollers 112. As more particularly shown in FIGS. 5 and 6*a*–6*c*, the knife blade 110 is supported by a bar 114 which is, in turn, mounted for reciprocation in linear slides 116 provided respectively in spaced frame plates 118. The slides 116, made from a friction reducing material such as nylon for example, are aligned with the folding nip roller pairs 112 to accurately guide the knife blade 110 between the rollers on reciprocation of the blade. The individual rollers 112*a*–112*d*, which comprise the folding nip roller pairs 112, are designed to maintain significant structural rigidity under load to minimize deflection. For example, the rollers may respectively be constructed as a solid aluminum core coated with rubber with steel shafts knurled and pressed into the bored ends thereof. The lower rollers 112*b*, 112*d* of the roller pairs are rotatably supported in the frame plates 118, while the upper rollers 112*a*, 112*c* are rotatably supported in spaced subframe plates 118*a*. The subframe plates 118*a* are connected to the frame plates 118 respectively by pivot pins 118*b* located downstream (in the direction of sheet travel) from the folding nip roller pairs. Accordingly, sheets being folded are urged by the knife blade 110 through one roller nip (i.e., between the rollers 112*a* and 112*b*) and then through the other roller nip (i.e., between the rollers 112*c* and 112*d*).

In order to accomplish neat folding of the sheets of the reproduction set, it is necessary to provide a desired predetermined engagement force between the rollers of the folding roller nip pairs 112 as the sheets of the reproduction set are urged therebetween. Accordingly, a compression assembly 120 is provided. The compression assembly 120 (best shown in FIGS. 5, 6*c*, and 7) includes an upper anchor bar 120*a* interconnected between the frame plates 118 and a lower anchor bar 120*b* interconnected between the subframe plates 118*a*. A pair of compression springs 122 are retained between the upper anchor bar 120*a* and the lower anchor bar 120*b* by long bolts 124. The long bolts are guided in bearings in the upper anchor bar and are threaded to the lower anchor bar to maintain a predetermined preload force between the bars and thus between the associated structure including, ultimately, the nip roller pairs 112. The attachment of the upper and lower anchor bars to the frame plates and subframe plates respectively are by way of pivot pins 126. The pivot pins 126 enable the anchor bars 120*a*, 120*b* to pivot relative to the frame plates 118 and the subframe plates 118*b* in order to prevent binding of the long bolts 124 as the springs 122 compress during the folding operation.

The provision of folding nip roller pairs 112 offers several significant advantages in the operation of the folding mechanism 94. Due to the location of the compression springs 122 of the compression assembly 120 relative to the nip roller pairs 112 and the pivotal relationship between the upper rollers and lower rollers of the nip roller pairs, a different mechanical advantage is exhibited at each of the nip roller pairs. Specifically, the mechanical advantage at the second nip roller pair (rollers 112*b* and 112*d*) closest to the pivot axis of the subframe plates 118*a* is significantly greater than the mechanical advantage at the first nip roller pair (rollers 112*a* and 112*c*), for example on the order of twice as large. Therefore, the fold formed in the reproduction set is accomplished in two steps of increasing clamping force. Thus the force at the first nip roller pair may be set to be substantially less than has heretofore been necessary to accomplish the desired booklet folding. With this arrangement, it is not a concern that the fold at the first nip roller pair be complete, and accordingly the force at such first nip pair can be set to assure the starting of an accurate and neat fold without forcing the reproduction set to be folded into the nip under such pressure as might damage the set. Moreover, as the reproduction set being folded passes through the first nip roller pair, the subframe plates 118*a* are wedged slightly open relative to the frame plates 118. Therefore, the greater force-applying second nip roller pair is already somewhat spread apart to readily receive the reproduction set being folded to complete the folding operation. With this arrangement then, the first nip roller pair is thus wedged open with a relatively light (non-damaging to the reproduction set) force irrespective of the thickness of the reproduction set being folded, and the second nip roller pair is accordingly partially opened by the set passing through the first nip roller pair. As a result, the folding mechanism 94 is effectively operational to automatically fold reproduction sets of various thicknesses without the need for a nip gap adjustment mechanism as would be required to accommodate various reproduction set thicknesses when only one nip roller pair is utilized to accomplish the folding operation.

Figure 6B:
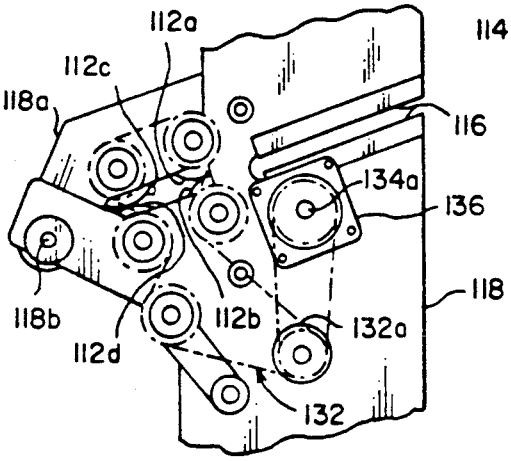
FIGS. 6*a*–6*c* are rear elevational views of the folding mechanism of the saddle stitcher, in cross-section and with portions removed or broken away, respectively taken along the lines designated 6*a*—6*a*, 6*b*—6*b*, and 6*c*—6*c* of FIG. 5.
Figure 6C:
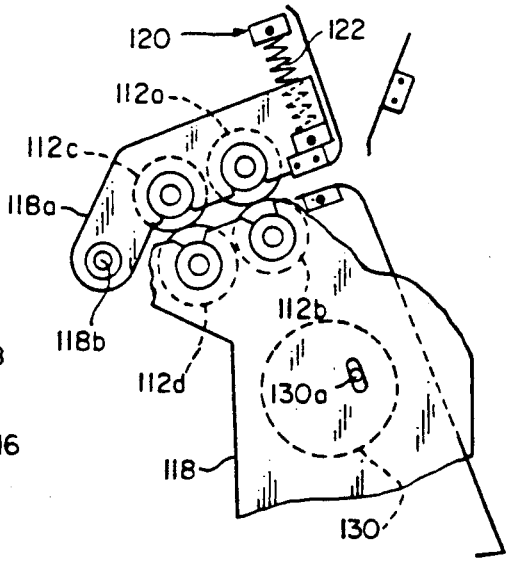
Figure 6A:
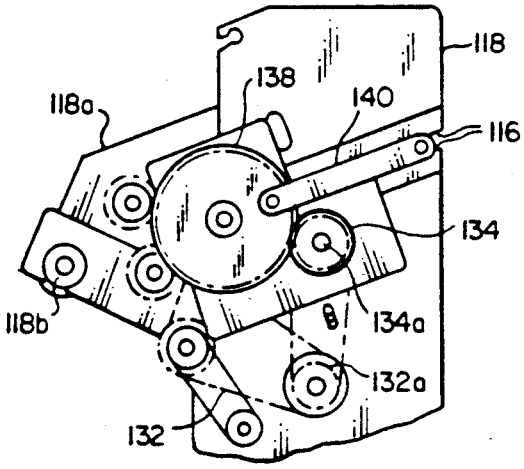
Figure 7:
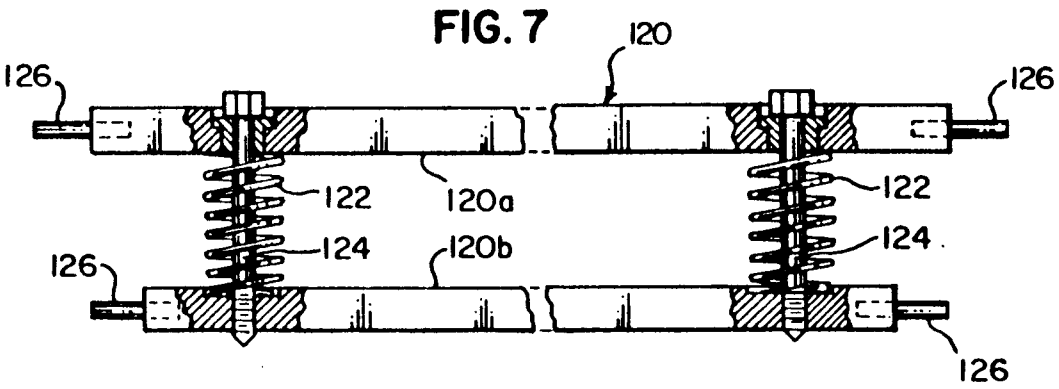
FIG. 7 is a side elevational view of the compression assembly of the saddle stitcher folding mechanism.

In order to effect selective reciprocation of the knife blade 110, under the control of unit C, the folding mechanism 94 of the saddle stitcher 90 includes a motor 130 having an output shaft 130*a* (see FIG. 6*c*). The output shaft 130*a* is drivingly connected to a main pulley 132*a* of a belt-and-pulley drive arrangement 132 (see FIG. 6*b*). A plurality of elements of the drive arrangement 132 are coupled respectively to the rollers 112*a*–112*d* of the folding roller nip pairs 112 to continuously rotate the rollers. Further, elements of the drive arrangement 132 are coupled to drive gears 134, fixedly mounted on a cross shaft 134*a*, through a clutch mechanism 136 to rotate the cross shaft (and thus the drive gears) on actuation of the clutch mechanism. The drive gears 134 mesh with cranks 138 (see FIG. 6*a*) which have links 140 pivotably connected at their respective ends to the cranks and the knife blade support bar 114.

A switch (not shown) of any well known type detects the angular position of the cranks 138 and provides a signal for the control unit C to effect actuation of the clutch mechanism 136. Such clutch mechanism actuation occurs for one revolution of the cranks 138 so that for each reproduction set to be folded, the knife blade 110 is reciprocated through one complete stroke. A complete stroke of the knife blade 110 contemplates travel of the blade a distance sufficient to urge the reproduction set being folded completely through the folding mechanism 94 and out of the nip roller pairs 112 where the formed booklet falls under the influence of gravity into the output hopper 98. The hopper 98 is mounted in the housing 32 of the modular finisher 10 on slides 98*a* so as to enable the hopper to move to a convenient location, for example external to the housing, to facilitate operator retrieval of the folded booklets collected in the hopper.

In one embodiment of the saddle stitcher 90 according to this invention, the links 140 are of somewhat different lengths. Accordingly, the angle of the knife blade 110 relative to the folding nip roller pairs 112 changes during the reciprocation of the knife blade. As a result, the reproduction set being folded is sent into the nips of the roller pairs at a skewed angle (rather than squarely with respect to the nips) so that the edge being folded does not contact the nip rollers all at once. Rather, the fold is effected sequentially in the direction of the fold during a segment of the travel distance of the reproduction set through the nip. This results in a tighter fold than can be accomplished when the fold is produced all at once (for a given nip pressure), and reduces the noise and power to complete the fold.

Figure 8B:
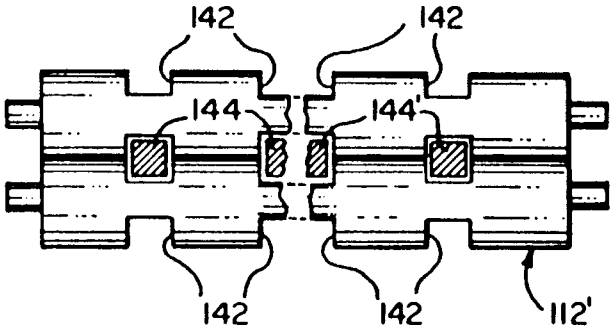
FIGS. 8*a* and 8*b* are front and side elevational views respectively of an alternate embodiment of the folding nip roller pairs and knife blade of the folding mechanism for the saddle stitcher of the modular finisher apparatus according to this invention.
Figure 8A:
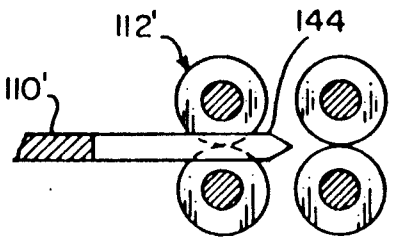

In another embodiment of the saddle stitcher according to this invention, the rollers of the folding nip roller pairs have a plurality of under-cut portions for accepting a complementary shaped knife blade. As shown in FIGS. 8*a* and 8*b*, an exemplary roller pair designated by the numeral 112' has undercut portions 142. Such under-cut portions readily receive complementary portions 144 of the knife blade 110' in a substantially non-contacting manner. With such arrangement, the angle of the knife blade to the nip roller pairs can be kept square, thus assuring a square fold in forming the reproduction set into a folded booklet, and the force on the roller pairs to effect folding is substantially independent of the insertion of the knife blade therebetween.

Turning now to the module defining the insert tray 150 (shown in FIG. 1), the insert tray is for the purpose of providing the modular finisher 10 according to this invention with the ability to selectively add additional sheets to a reproduction set. For example the additional sheets may be preprinted cover sheets of the same or different stock characteristics to the sheets of the reproduction set, or may be sheets utilized within a reproduction set to separate distinct portions of the set. The insert tray 150 includes a sheet receiving hopper 152 removably locatable in the top cover 154 for the finisher 10. The hopper 152 has appropriate guides (not shown) for aligning a stack of sheets therein relative to a sheet feed device 156. The sheet feed device 156, of any well known type such as a scuff feeder or a vacuum feeder for example, is activated by the control unit C when it is desired to selectively feed a single sheet from the hopper 152 to have such sheet inserted into a reproduction set being received by the finisher 10. The sheet is fed into a transport path $P_4$ communicating with the transport path $P_1$ of the upper transport module 20 between the entrance E and the diverter 28. Accordingly, the additional sheet is selectively inserted into the path $P_1$ at a desired time during the finishing of a reproduction set to be treated the same as any other sheet in the set during the finishing operation.

The invention has been described in detail with particular reference to preferred embodiments thereof, but it will be understood that variations and modifications can be effected within the spirit and scope of the invention.

We claim:

1. For use with a reproduction apparatus producing reproduction sets of a series of reproductions reproduced on sheets respectively, an improved modular finisher apparatus for forming completely finished reproduction sets, said improved modular finisher apparatus comprising:

a first housing;

a cover for said first housing;

first auxiliary modular device receiving means for receiving an auxiliary modular device in said cover;

means in said first housing for receiving sheets of reproduction sets from said reproduction apparatus;

means in said first housing for defining a first feed path extending from said receiving means;

second auxiliary modular device receiving means for receiving an auxiliary modular device in said first housing;

a second housing associated with said first housing;

means in said second housing communicating with said first feed path defining means for collecting sheets from said first feed path defining means;

means in said second housing for stapling collected sheets into stapled reproduction sets;

means associated with said second housing for collecting stapled reproduction sets;

means, in said second housing defining a second feed path from said sheet collecting means to said set collecting means, for directing stapled reproduction sets from said sheet collecting means to said set collecting means;

third auxiliary modular device receiving means for receiving an auxiliary modular device in said second housing;

at least one auxiliary modular device selected from the group of a Z-folder, a saddle stitcher, and an insert tray; said selected at least one auxiliary modular device being received in said first, second, or third auxiliary modular device receiving means; and means for providing sheet transport paths from said first feed path defining means to any of the selected auxiliary modular devices.

2. The invention of claim 1 wherein said reproduction set collecting means includes an output hopper attached to said second housing externally thereof, and an opening defined in said second housing, said opening being located so as to provide communication between said second feed path defining means and said output hopper.

3. The invention of claim 2 wherein said output hopper includes a tray, an elevator mechanism coupled to said tray to selective raise and lower said tray relative to said opening in said second housing so as to position the top of a stack of reproduction sets received on said tray at a level to receive the next subsequent reproduction set on the top such stack.

4. The invention of claim 3 wherein said output hopper further includes a mechanism coupled to said tray for selectively moving said tray in a direction transverse to the direction of movement of a reproduction set as it is received in said tray, and means for controlling operation of said mechanism between the receiving of sequential reproduction sets so that such sets are relatively offset when stacked on said tray.

5. The invention of claim 3 wherein said tray of said output hopper is positioned relative to the direction of movement of reproduction sets received at said tray at an angle to the horizontal so as to intercept the path of such sets received at said tray.

6. The invention of claim 5 wherein said output hopper further includes a guide plate located relative to said tray so as to align the lead edges of reproduction sets received on said tray, and means for applying a force to the stack of reproduction sets on said tray to retain such stack its in aligned position against said guide plate.

7. The invention of claim 6 wherein said force applying means includes at least one finger mounted for movement to a position in contact with the topmost set in the stack of reproduction sets on said tray and a position remote from said stack, and means for selectively moving said at least one finger to its remote position as a set is received on said stack on said tray so as not to interfere with receiving of such set, and thereafter moving said at least one finger to its contact position to hold such stack in its aligned position against said guide plate.

8. The invention of claim 1 wherein said first housing further includes a proof set collection tray, means defining an alternate feed path communicating with said first feed path defining means and extends to said proof set collection tray, and means for selectively diverting sheets from said first feed path defining means to said alternate feed path defining means for delivery of sheets to said proof set tray.

9. The invention of claim 8 further including control means for: (1) controlling said reproduction apparatus to effect production of additional reproduction set above the desired number of requested reproduction sets, (2) setting said diverting means to direct the sheets comprising the first reproduction set to said proof set tray, and (3) delaying production of the second and subsequent reproduction sets for a time sufficient to enable the reproduction set directed to said proof set tray to be examined.

10. In a reproduction apparatus having, associated therewith, an improved modular finisher apparatus for forming completely finished reproduction sets of a series of reproductions produced on sheets respectively by said reproduction apparatus, said improved modular finisher apparatus including a proof set collection tray, means for stapling collected sheets into stapled reproduction sets, and at least one auxiliary modular device selected from the group of a Z-folder, a saddle stitcher, and an insert tray, a method for interactively operating said reproduction apparatus and said improved modular finisher comprising the steps of:

(1) controlling said reproduction apparatus to effect production of an additional reproduction set above the desired number of requested reproduction sets;

(2) diverting the sheets comprising the first reproduction set to the proof set tray of the modular finisher apparatus; and (3) delaying production of the second and subsequent reproduction sets for a time sufficient to enable the reproduction set directed to the proof set tray to be examined.

11. The invention of claim 10 further including the steps of:

on examination of the reproduction set from the proof set tray, determining if such reproduction set is in a desired condition; and if the examined reproduction set is not in the desired condition, cancelling operation of the reproduction apparatus, correcting the condition of the reproduction set and repeating the steps (1)–(3) above.

* * * * *